US005836324A

United States Patent [19]

Johnson et al.

[11] Patent Number: 5,836,324

[45] Date of Patent: Nov. 17, 1998

[54] VENT SEAL ARRANGEMENT

[75] Inventors: Thomas M. Johnson; Brian L. Ness, both of Jackson, Tenn.

[73] Assignee: Maytag Corporation, Newton, Iowa

[21] Appl. No.: 897,818

[22] Filed: Jul. 21, 1997

[51] Int. Cl.[6] ..... A47L 15/48

[52] U.S. Cl. ..... 134/58 D; 34/235; 134/95.2; 134/183; 134/200; 312/213

[58] Field of Search ..... 134/56 D, 57 D, 134/57 DL, 58 D, 58 DL, 95.2, 200, 201; 34/235; 236/48 R, 49.5, 93 R; 312/213, 228, 400

[56] References Cited

U.S. PATENT DOCUMENTS

| | | | |
|---|---|---|---|
| 857,452 | 6/1907 | Farmer | 236/49.5 |
| 1,757,987 | 5/1930 | Whittier | 236/49.5 |
| 3,023,757 | 3/1962 | Mixon . | |
| 3,050,866 | 8/1962 | Macemon . | |
| 3,064,662 | 11/1962 | Given et al. | 134/95.2 |
| 3,092,122 | 6/1963 | Guth . | |
| 3,170,743 | 2/1965 | Martiniak . | |
| 3,193,340 | 7/1965 | Braden . | |
| 3,387,388 | 6/1968 | Williamson . | |
| 3,398,756 | 8/1968 | Kauffman . | |
| 3,588,213 | 6/1971 | Braga et al. . | |
| 3,616,810 | 11/1971 | Ter Bush . | |
| 3,680,940 | 8/1972 | Johansson et al. . | |
| 3,876,469 | 4/1975 | Schimke . | |
| 4,179,821 | 12/1979 | Herbst et al. | 34/235 |
| 4,184,500 | 1/1980 | Herbst | 134/114 |
| 4,247,158 | 1/1981 | Quayle | 134/200 X |
| 4,561,588 | 12/1985 | Foller | 236/93 R X |
| 4,709,488 | 12/1987 | Anselmino et al. | 34/235 |
| 5,056,543 | 10/1991 | Dygve | 134/107 |
| 5,263,643 | 11/1993 | Wells et al. | 236/48 R |
| 5,277,210 | 1/1994 | Kim | 134/95.2 |
| 5,287,868 | 2/1994 | Tuller et al. | 134/95.2 |
| 5,341,827 | 8/1994 | Kim | 134/107 |
| 5,660,195 | 8/1997 | Taylor, Jr. et al. | 134/95.2 X |

*Primary Examiner*—Philip R. Coe
*Attorney, Agent, or Firm*—Zarley, McKee, Thomte, Voorhees & Sease

[57] ABSTRACT

The present invention relates to a vent seal device for an automatic dishwasher. The dishwasher includes a door having a vent opening therein. An elongated flexible strip is mounted in the door adjacent and generally registered with the vent opening. The strip has opposite ends and a central portion therebetween. At least one end of the strip is secured against movement with respect to the frame. During certain times of the wash and rinse cycles the strip is deflected into sealing engagement with the vent opening, thereby closing the normally open vent opening.

20 Claims, 6 Drawing Sheets

VENT SEAL ARRANGEMENT

BACKGROUND OF THE INVENTION

The present invention relates to the field of cleaning appliances, in particular, automatic dishwashers. This invention is a vent seal arrangement for selectively allowing warm moist air to escape from the washing chamber of the dishwasher.

Various vent arrangements are found in conventional automatic dishwashers. In some of these arrangements, the vent always remains open. Thus, heat, moisture and noise may escape from the dishwasher during the wash and rinse portions of the cycle. Other dishwashers have vents which are mechanically closed during certain portions of the cycle by a timer. However, the mechanical connections required can consume a significant amount of space in or around the door, where the vent is usually located. Therefore, there is a need for a vent which can be closed during the wash and/or rinse portion of the cycle without the addition of bulky mechanical connections.

Therefore, a primary object of the present invention is the provision of an improved vent seal arrangement for a dishwasher.

A further object of the present invention is the provision of a dishwasher vent seal arrangement which is heat actuated.

A further object of the present invention is the provision of a dishwasher vent seal which has a deflectable strip movable between open and closed positions relative to the vent opening.

A further object of the present invention is the provision of a dishwasher vent seal which includes a deflectable strip having one end held against movement and another end movable axially toward the held end so as to deflect the strip into blocking or sealing engagement with the vent opening.

A further object of the present invention is the provision of a vent seal arrangement which is heat actuated through an electrical means.

A further object of the present invention is the provision of a dishwasher vent seal having a deflectable strip comprising two layers of material having different coefficients of thermal expansion such that heat causes the central portion of the strip to deflect when the ends are held in place.

A further object of the present invention is the provision of a vent seal arrangement which is generally centered along the width of the dishwasher door.

A further object of the present invention is the provision of a vent seal arrangement which is economical to manufacture, durable in use and simple in construction.

These and other objects will be apparent to those skilled in the art from the drawings, description and claims which follow.

SUMMARY OF THE INVENTION

The present invention relates to a vent seal arrangement for an appliance such as an automatic dishwasher. The arrangement provides a vent seal for sealing the vent opening. The vent seal includes an appliance door frame having a vent opening therein. An elongated flexible strip is mounted on the door frame adjacent and generally registered with the vent opening. The strip has opposite ends and a central portion therebetween. At least one end of the strip is secured against movement with respect to the door frame. Normally the strip is in a static state leaving the vent open.

Upon actuation, the strip bows or deflects into closing engagement with the vent opening to prevent the escape of heat, air or moisture from the washing chamber of the dishwasher. Means for selectively deflecting and bowing the central portion of the strip into sealing engagement with the vent opening are provided.

In one embodiment, a free end of the strip is pushed toward a secured end of the strip by a linear actuator so as to deflect or bow the central portion of the strip toward the vent opening. A wax motor can serve as the linear actuator. A gasket can be attached to the strip to improve the seal.

In another embodiment, both ends of the strip are secured, with the strip comprising two layers of material having dissimilar coefficients of thermal expansion. The layer with the higher coefficient of thermal expansion is directed toward the vent opening so that the strip bows into the vent opening when heated, thereby closing the vent opening.

BRIEF DESCRIPTION OF THE DRAWINGS

FIG. 11 illustrates the open vent condition.

FIG. 13 shows the vent in an open position.

DETAILED DESCRIPTION OF THE PREFERRED EMBODIMENT

Figure 1:
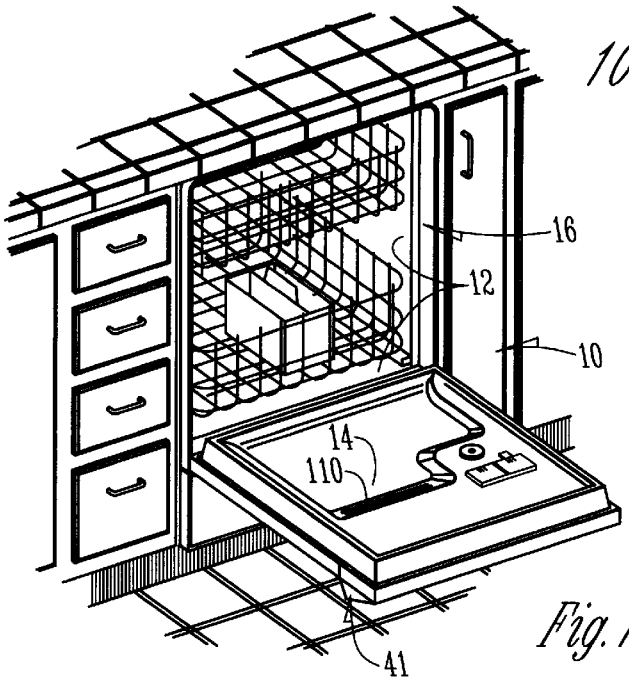
FIG. 1 is a perspective view of an automatic dishwasher with the door in an open position.

Referring to FIG. 1, the reference numeral 10 generally denotes a built-in automatic dishwasher. The dishwasher 10 has a plurality of interior walls 12 and a door 14 which enclose a washing chamber 16 for cleaning dishes.

Figure 3:
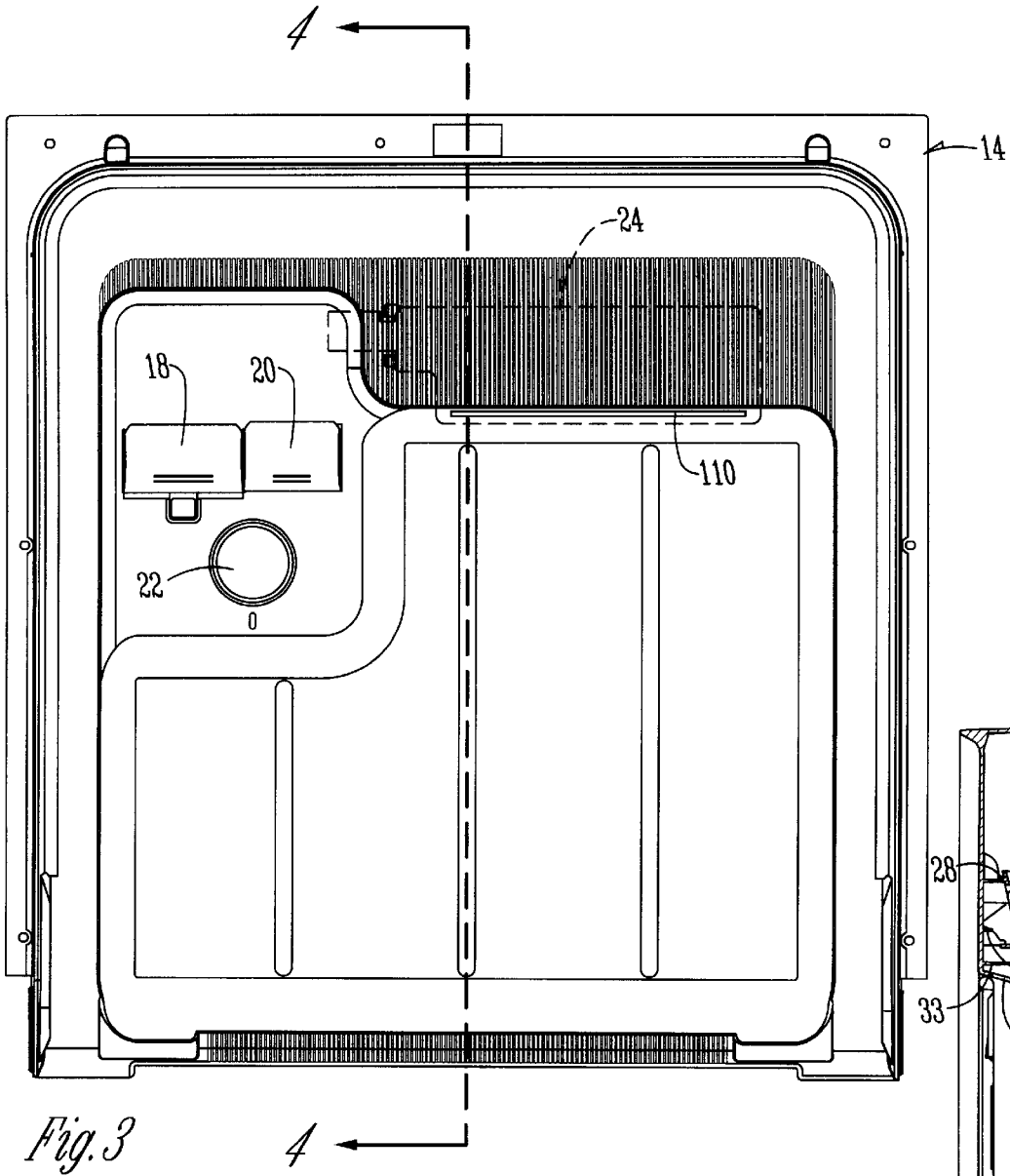
FIG. 3 is an elevation view of the interior of the dishwasher door equipped with the vent assembly of the present invention.
Figure 4:
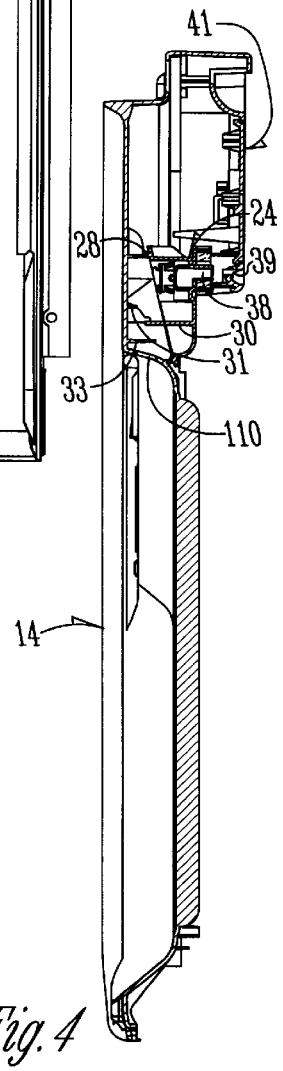
FIG. 4 is a cross-sectional view of the dishwasher door taken along line 4—4 in FIG. 3.
Figure 5:
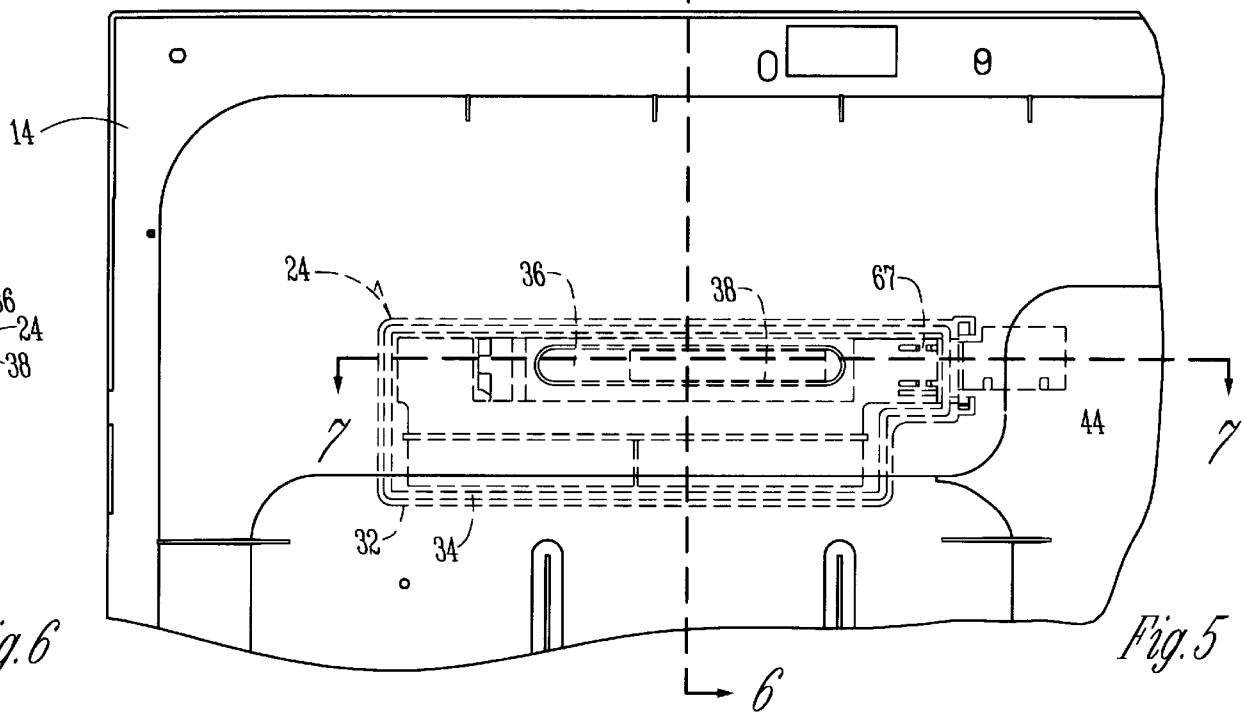
FIG. 5 is a fragmentary view of the dishwasher door showing the vent assembly of the present invention in dashed lines.
Figure 6:
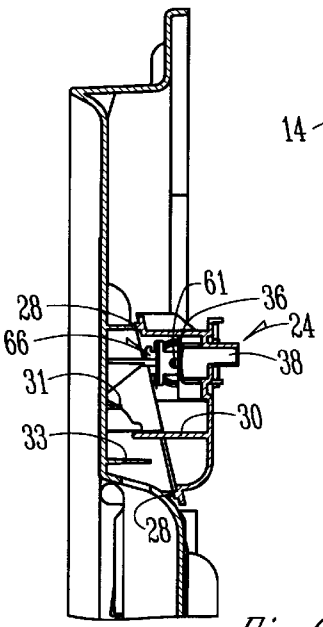
FIG. 6 is a cross-sectional view of the vent assembly arrangement of the present invention taken along lines 6—6 in FIG. 5.

FIG. 3 shows the inside of the door 14. Conventional detergent holding compartments 18, 20 and a rinsing aid reservoir 22 are provided on the inside of the door 14. A vent assembly 24 is mounted inside the door 14, as indicated by the dashed lines in FIGS. 3 and 5. FIGS. 4 and 6 also show the location of the vent assembly 24 within the door 14.

Figure 9:
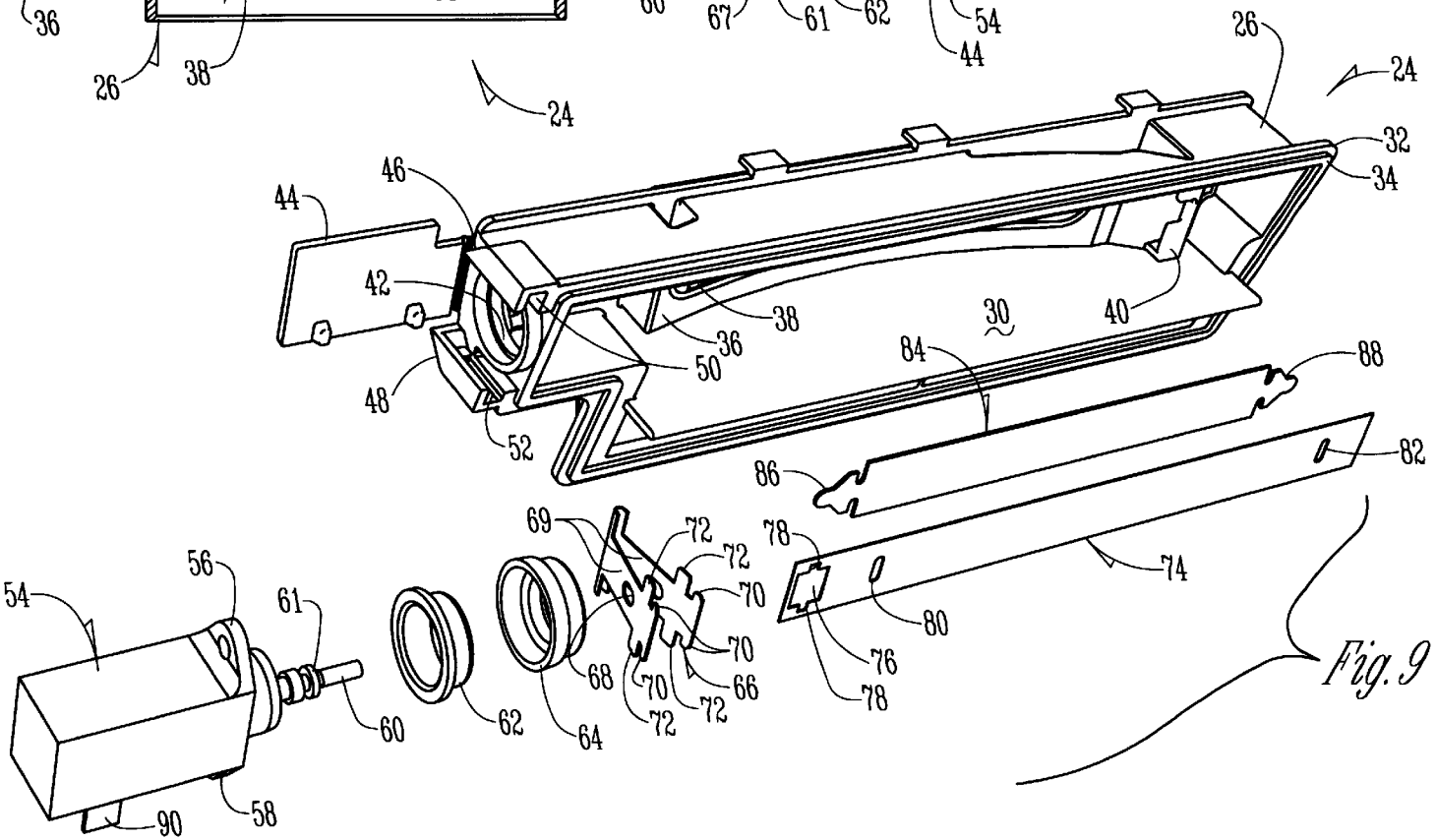
FIG. 9 is an exploded perspective assembly view of the vent assembly of the present invention.
Figure 10:
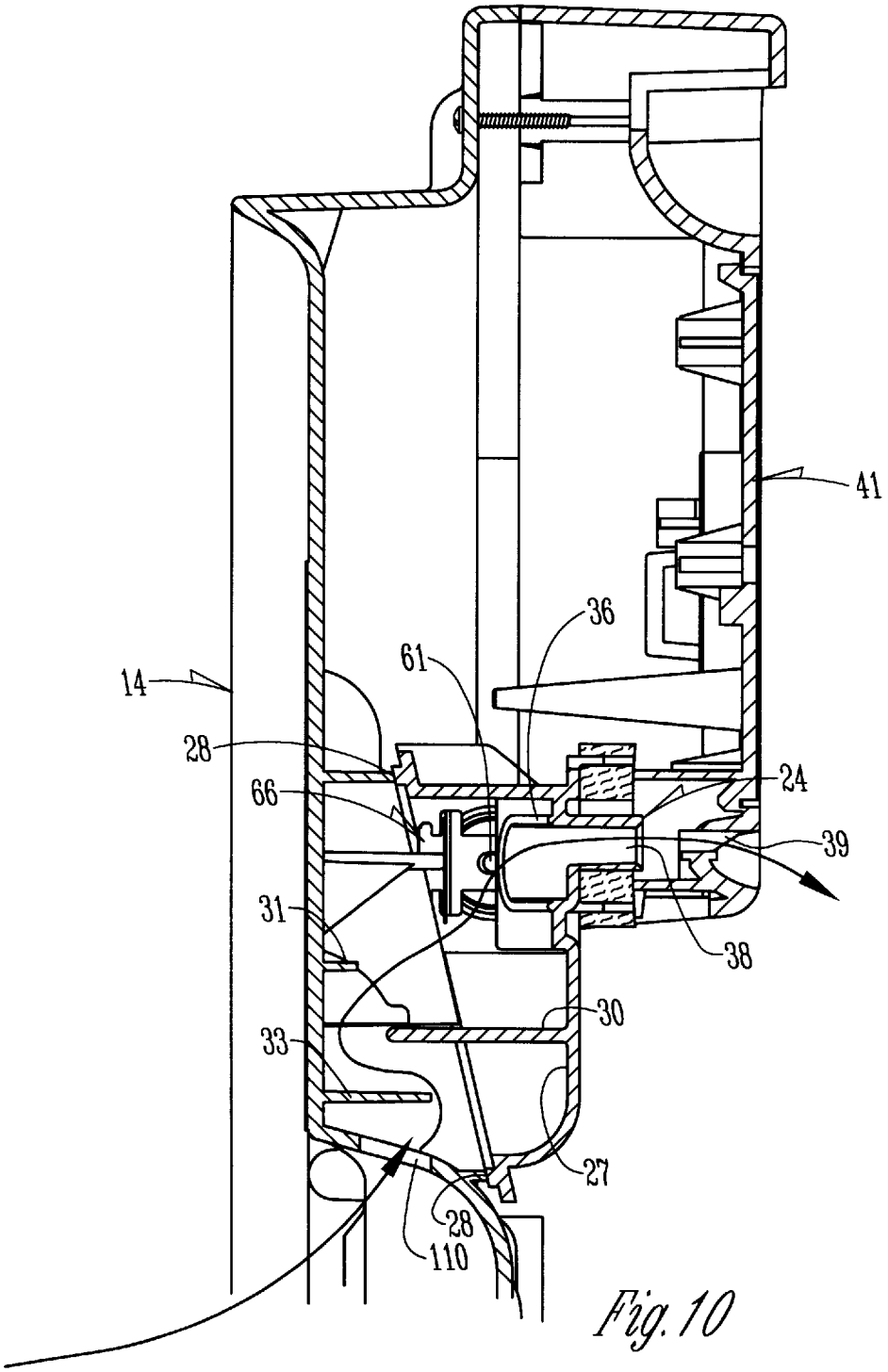
FIG. 10 is an enlarged cross-sectional view taken of the door area designated 10—10 in FIG. 2.

The vent assembly 24 has a housing 26 which is mounted to the interior of the door 14. Preferably the housing 26 is constructed of a thermosetting plastic material which is rigid, durable and lightweight. Referring to FIGS. 9 and 10, a baffle member 30 extends outwardly from the bottom wall 27 of the housing 26 and extends outward from the front rim 32 of the housing 26. The baffle member 30 extends transversely across the housing 26. As best seen in FIG. 10, baffle member 30 cooperates with baffles 31, 33 in the door 14 to prevent wash water from entering the housing 26.

A raised bead member 34 (FIG. 9) extends around the front rim 32 to facilitate mounting of the vent cartridge 24 to the door 14 such as by ultrasonic or hot plate welding along edge 28 as shown in FIGS. 4, 6 and 10. A vent duct cradle member 36 protrudes or raises from the bottom wall 27 of the housing 26. The cradle member 36 can be integrally molded with the housing 26. A portion of the top surface of the cradle member 36 is concave and has an elongated vent duct opening 38 therein which extends through the cradle member 36 to exit the housing 26 and thereafter the door 14 through an opening 39 (see FIGS. 2, 4, 7, 8 and 10).

One end of the cradle member 36 has a holding or retaining means 40 thereon. The retaining means 40 can be integrally formed as a raised ear on the end of the cradle 36. A groove or slot in the ear is adapted to receive and hold one end of an elongated vent blocking strip 74 discussed in greater detail below.

A hole 42 extends through one end of the housing 26 and is generally aligned with the longitudinal axis of the vent duct opening 38. A shield 44 is flexibly attached to the housing 26 adjacent the hole 42 and extends outwardly beyond the entrance of the hole 42 as shown in FIG. 9. Flanges 46, 48 also extend from the housing 26 adjacent the hole 42 and have locking slots 50, 52 therein extending in a direction generally transverse to the longitudinal axis of the vent duct opening 38.

The vent assembly 24 includes a linear actuator 54 operatively mounted in the hole 42 of the housing 26. The linear actuator 54 is preferably a wax motor heated by an electrical input current and is available from U.S. Controls Corporation as part number 11176-61. The wax motor 54 has mounting flanges 56, 58 which slide into the slots 50, 52 when the nose of the wax motor 54 is positioned in the hole 42. The wax motor 54 is then rotated into a locked position. The wax motor 54 has a plunger 60 which extends through the hole 42 and extends or retracts in a conventional manner in response to the heat generated by an internal positive temperature coefficient (PTC) thermistor energized by the electrical current supplied to the motor 54. Seals 62 and 64 extend over the nose of the wax motor 54 and around the plunger 60. The plunger 60 has an engagement flange or shoulder 61 thereon.

A V-shaped pivotal bracket 66 has its apex positioned in a groove 67 at the bottom of the housing 26 between the cradle member 36 and the hole 42. The arms 69 of the pivotal bracket 66 are identical and have holes 68 therethrough. The plunger 60 extends through the holes 68. The engagement flange 61 is adapted to abut the first arm 69 adjacent its hole 68 when the wax motor 54 is installed and rotated into the locked position discussed below. The free end of each arm 69 has a pair of small outwardly projecting upper fingers 70 thereon. Similarly, a pair of larger outwardly projecting lower fingers 72 are spaced apart below the upper fingers 70.

The vent assembly 24 also includes an elongated, thin, flat, deflectable vent blocking strip 74. The preferred material for the strip 74 is spring type 301 stainless steel with a thickness of less than 1/32", preferably about 0.012". The vent blocking strip 74 is of sufficient length and width to completely cover or superpose the vent duct opening 38. The strip 74 is adjacent to and generally registered with the vent duct opening 38. An aperture 76 extends through the strip 74 adjacent one of its ends (the free end). A slot 78 extends laterally beyond the aperture 76 on either side so as to allow for the insertion and removal of the upper fingers 70 of the arms 69, but not the lower fingers 72 of the arms 69. A pair of transverse slits 80, 82 are longitudinally spaced and extend through the vent blocking strip 74 inwardly of the aperture 76.

A sealing means or gasket 84 may be provided and includes tabs 86, 88 which are insertable into the slits 80, 82 of the vent blocking strip 74. The tabs 86, 88 have an arrowhead-like construction so that they will normally be retained in the slits 80, 82 once the tip has been fully inserted. The gasket 84 is snugly attached to one side of the vent blocking strip 74 so as to be operatively interposed between the vent blocking strip 74 and the vent duct opening 38 in the cradle member 36. It is contemplated that the gasket 84 could be integrally formed on the strip 74. Preferably the gasket 84 is comprised of silicone rubber or other suitable elastomeric material.

Assembly of the vent assembly 24 includes the following steps. The gasket 84 is attached to one side of the vent blocking strip 74 by pulling the tabs 86, 88 through the slits 80, 82. The arms 69 of the pivotal bracket 66 are squeezed together and the upper fingers 70 of the bracket 66 are inserted into the slot 78 of the vent blocking strip 74, then released.

Next, the sub assembly comprising the gasket 84, the strip 74, and the pivotal bracket 66 is inserted into the housing 26. The end of the strip 74 opposite the aperture 76 is inserted into the retention means 40 so as to extend over the vent duct opening 38. The pivotal bracket 66 is placed into the groove 67 in the bottom of the housing 26.

Then the nose of the wax motor 54 (with the seals 62,64 installed thereon) can be inserted into the hole 42 in the housing 26. The plunger 60 extends through the hole 68 in first arm 69 of the pivotal bracket 66, and the engagement flange 61 abuts the second arm 69. Next, the installer rotates the wax motor 54 and locks it in place by inserting the mounting flanges 56, 58 into the slots 50, 52.

The vent cartridge 24 can now be attached to the dishwasher door 14 by ultrasonic or hot plate welding the housing 26 to the door 14 along edge 28. The installer then attaches electrical wires to the electrical connectors 90 on the wax motor 54 to wire the vent cartridge 24 into the dishwasher control system.

Figure 7:
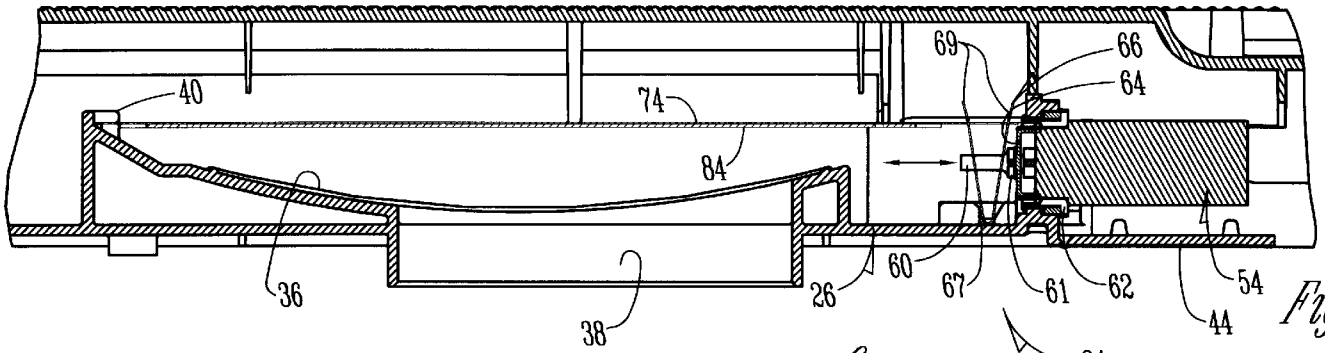
FIG. 7 is a cross-sectional view of the vent assembly arrangement of the present invention taken along lines 7—7 in FIG. 5, and shows the open position of the vent blocking strip of the seal arrangement.
Figure 8:
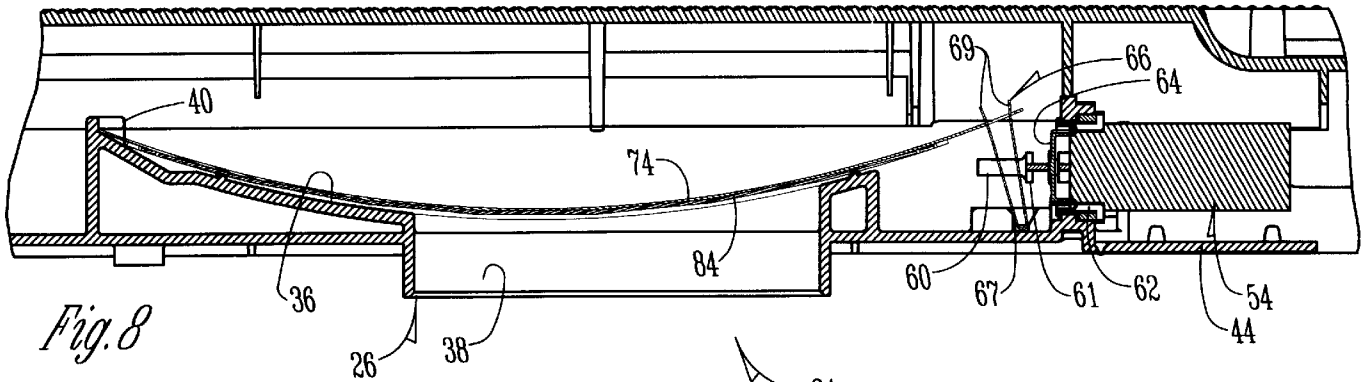
FIG. 8 is a cross-sectional view similar to FIG. 7, but shows the strip bowed or deflected into a closed position with respect to the vent.

In operation, the vent seal arrangement opens and closes the vent duct opening 38. Generally, it is desirable to have the vent open during at least part of the drying cycle of the dishwasher 10 and closed during the wash or rinse portion of the cycle. The plunger 60 of the wax motor 54 is normally retracted such that the strip 74 is in a relaxed or static state spaced apart from the vent opening 38, as shown in FIG. 7. Thus, the vent opening 38 is open for venting air from the dishwasher chamber 16. The vent duct 38 can remain open until the next wash or rinse cycle. During the closed or non-venting portion of the cycle, electrical current is sent to the linear actuator or wax motor 54 by the dishwasher control system as a part of its normal operating cycle. The wax motor plunger 60 extends in response to the heat produced by the internal PTC heater energized by the electrical current. When the plunger 60 extends, it pushes the pivotal bracket 66 toward the cradle member 36. Consequently, the aperture end of the vent blocking strip 74 is axially forced towards the retained end of the strip 74. The central portion of the strip 74 bends, deflects, or bows into the cradle member 36. Thus, the strip 74 closes or seals the vent duct opening 38, as best seen in FIG. 8. The vent duct opening 38 can be closed whenever the control system supplies electrical current, however, the opening 38 is preferably closed during the wash and rinse portions of the cycle and open during the drying portion of the cycle.

Figure 2:
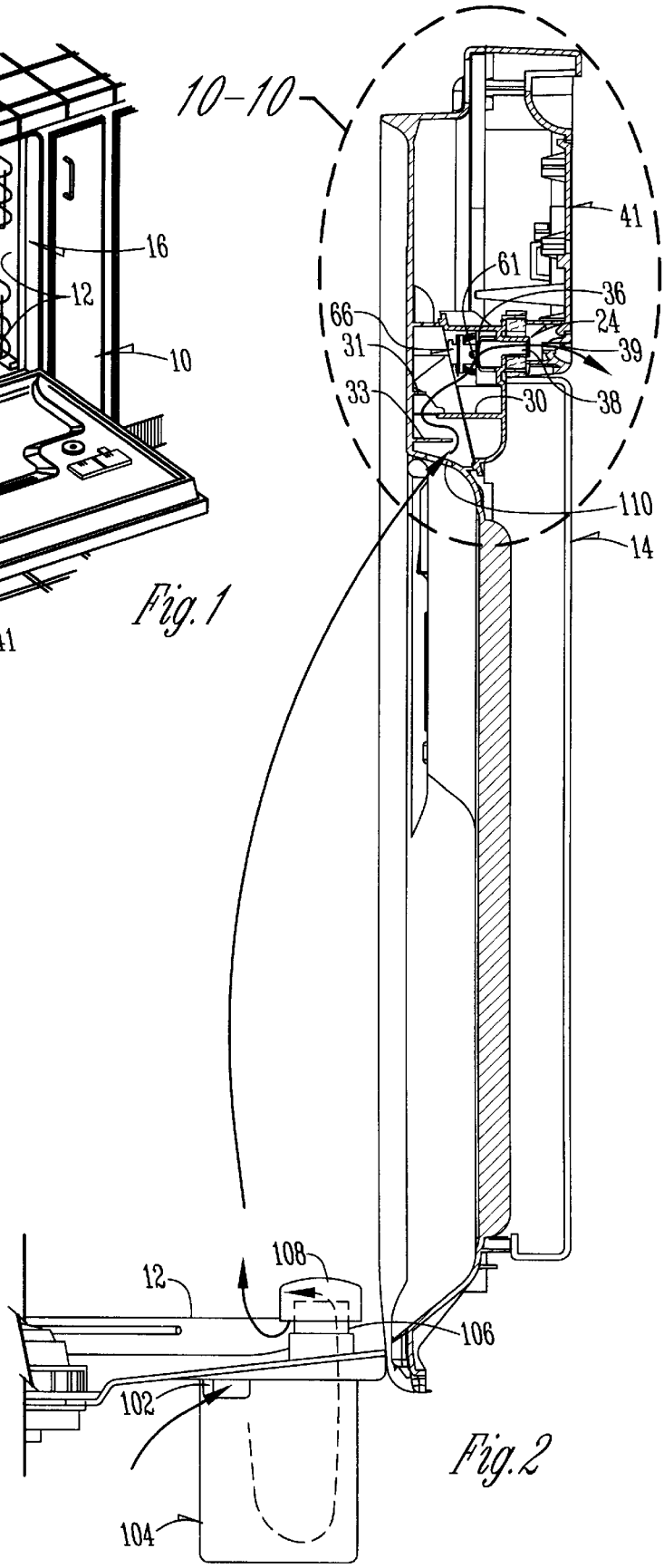
FIG. 2 is a cross-sectional view of the dishwasher door of FIG. 1 in a closed position, showing the flow of warm, moist air through the washing chamber and vent opening.

While the vent duct 38 is open, warm moist air, as indicated by the arrows in FIGS. 2 and 10, is allowed to escape the washing chamber 16 by passing around the baffle member 30 and out the vent duct opening 38 in the vent cartridge 24. The outflowing air finally exits the control panel 41 attached to the upper portion of the door 14. The opening 39 in the control panel 41 and the vent duct opening 38 are sized to provide increased velocity to outflowing air. FIG. 7 illustrates the open position of the vent cartridge 24 wherein the vent blocking strip 74 is in an undeflected state which permits warm moist air to flow through the vent duct opening 38 and exit the control panel 41 through opening 39. FIG. 8 illustrates the vent blocking strip 74 in a deflected state wherein the vent duct opening 38 is blocked or sealed by the vent blocking strip 74.

Figure 11:
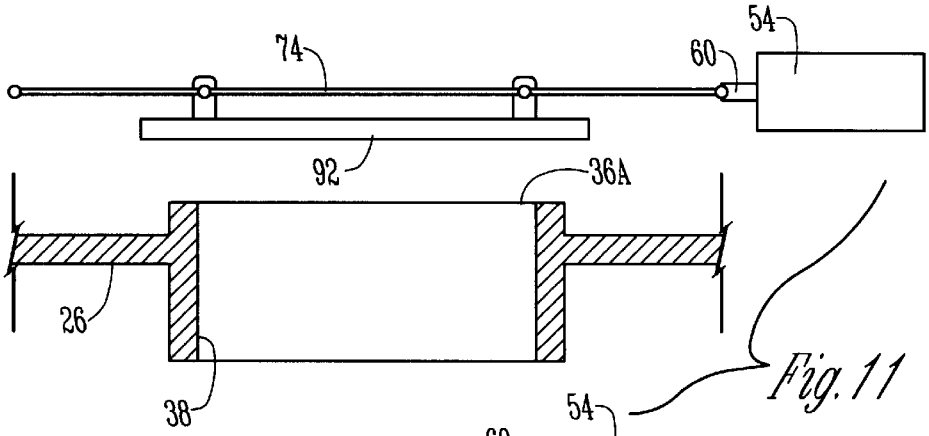
FIG. 11 is a simplified schematic diagram showing an alternate embodiment of the present invention wherein a cover plate is mounted to the strip.
Figure 12:
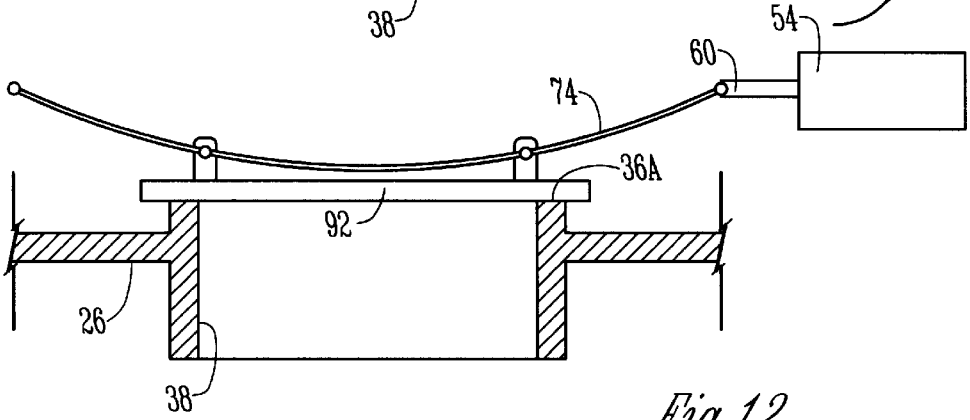
FIG. 12 is a simplified schematic diagram similar to FIG. 11, except the strip has been bowed into closing engagement with the vent.

FIGS. 11–14 illustrate alternative embodiments of this invention. In FIGS. 11–12, a flat rigid cover plate 92 is slidably attached to the strip 74 above the vent duct opening 38. When no electrical current is supplied to the wax motor 54, the plunger 60 is retracted and the strip 74 remains straight. As a result, the cover plate 92 does not contact the cradle member 36A. In FIG. 12, the plunger 60 of the wax motor 54 has been extended so that the strip 74 bows downwardly and urges the cover plate 92 into sealing engagement with the vent duct opening 38. Note that the upper surface of the cradle member 36A is flat or planar rather than arcuate or concave.

Figure 13:
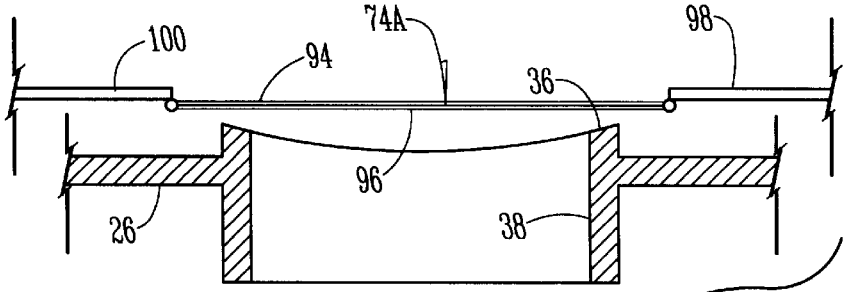
FIG. 13 is a simplified schematic view of another alternate embodiment wherein two layers of material having dissimilar coefficients of thermal expansion form the strip.
Figure 14:
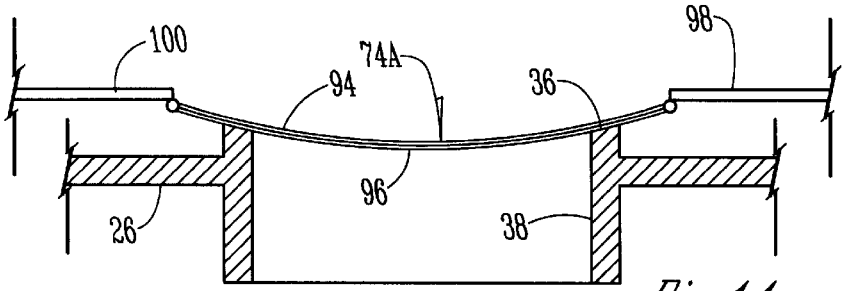
FIG. 14 is a simplified schematic view similar to FIG. 13, where the strip has been heated causing it to deflect and thereby close the vent.

In FIGS. 13 and 14, the vent blocking strip 74A comprises two distinct layers 94, 96 of material having dissimilar coefficients of thermal expansion. The vent blocking strip 74A can be a bimetal strip. Preferably layer 96, which is closer to the cradle member 36, has a higher coefficient of thermal expansion than the remote layer 94. The ends of the strip 74A are rigidly mounted to support structures 98 and 100. FIG. 13 shows the strip 74A in a straight condition wherein the vent duct opening 38 is unobstructed. FIG. 14 shows the vent blocking strip 74A in a bowed condition wherein sufficient heat has been applied to cause the vent blocking strip 74A to expand and thereby deflect into sealing engagement with the vent duct opening 38 and the cradle member 36.

Regardless of which embodiment of the vent blocking strip is used, the present invention provides vent sealing arrangement which allows warm, moist air to escape the dishwasher 10 as indicated by the arrows in FIG. 2. A convection air inlet is provided according to the U.S. Pat. No. 5,287,868 to Tuller et al. Air flows by convection into the opening 102 in the inlet device 104, through an inner cup (not shown), then up a chimney 106, then around a cap 108. The air draws warm, moist air from the washing chamber 16 into an opening or vent inlet 110 in the inside of the door 14 which is fluidly connected with the vent duct opening 38 or vent outlet. The warm, moist air flows around the baffles 30, 31, 33 and through the vent duct opening 38, if it is open. If so, the warm, moist air exits the dishwasher 10 through the exhaust outlet 39 in the door 14. The vent seal arrangement of the present invention facilitates the drying process while preventing the escape of moisture, heat and noise during other portions of the dishwashing cycle.

Therefore, it can be seen that the present invention at least satisfies its stated objects.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A vent seal for selectively sealing a vent outlet opening extending through a door of a dishwasher, comprising:

an elongated flexible strip adapted to mount adjacent to and generally registered with the vent outlet opening, the strip normally being disengaged from the vent outlet opening such that the vent outlet opening is open; and the strip being deflectable so as to sealingly engage and thereby close the vent outlet opening.

2. The vent seal of claim 1 wherein the strip has opposite ends and a central portion therebetween, at least one end of the strip being secured against movement with respect to the door.

3. The vent seal of claim 2 wherein the strip has a free end and a linear actuator operatively engages the free end so as to push the free end toward the secured end and thereby deflect the central portion into sealing engagement with the vent outlet opening.

4. The vent seal of claim 3 wherein the linear actuator is a wax motor.

5. The vent seal of claim 4 wherein the linear actuator includes a plunger which is axially movable and drivingly connected to a bracket pivotally mounted in a groove associated with the door, the plunger extending into an aperture in the free end of the strip so as to drivingly connect the actuator with the free end of the strip.

6. The vent seal of claim 2 wherein the secured end of the strip is secured by a slot in the door having a fixed depth and being adapted to receive the secured end of the strip and limit the longitudinal movement thereof.

7. The vent seal of claim 1 wherein the strip is deflectable in response to heat.

8. The vent seal of claim 7 wherein the strip has opposite ends and a central portion therebetween, at least one end of the strip being secured against movement with respect to the door, the strip comprising two layers of material joined together and having substantially dissimilar coefficients of thermal expansion, the layer of material with the higher coefficient of thermal expansion being proximate to the vent outlet opening whereby heat causes the central portion of the strip to deflect into substantially sealing relation with the vent outlet opening.

9. The vent seal of claim 1 wherein the vent seal is housed within a vent assembly which mounts in the door.

10. The vent seal of claim 9 wherein a vent inlet is located on the inside of the door and an exhaust outlet is located on the outside of the door, the vent assembly having a vent opening therein to provide an airway between the vent inlet and the exhaust outlet.

11. The vent seal of claim 9 wherein the vent assembly has a housing having a bottom wall that includes a raised cradle member thereon and the vent outlet opening extends through the cradle member and the bottom wall.

12. The vent seal of claim 11 wherein the cradle member is integrally formed with the housing.

13. The vent seal of claim 11 wherein the cradle member has a planar concave upper surface which intersects the vent outlet opening and is directed toward the strip.

14. The vent seal of claim 1 wherein the flexible strip is constructed of stainless spring steel having a thickness of less than 1/32 of an inch.

15. The vent seal of claim 1 wherein a rigid cover plate is suspended from the strip and is generally registered above the vent outlet opening for sealing the vent outlet opening when the strip is deflected.

16. The vent seal of claim 1 comprising a gasket member attached to the strip so as to seal the vent outlet opening when the strip deflects into covering relation with the vent outlet opening.

17. A vent seal for selectively closing a vent outlet opening in a dishwasher having a washing chamber and a door, the vent outlet opening being disposed in the door to provide for the escape of air from the washing chamber, comprising:

an elongated flexible strip mounted in the door and positioned over the vent outlet opening, the strip having opposite sides and opposite ends, at least one of the ends being fixed with respect to the door, the side proximate the vent outlet opening having a surface area sufficient to cover the vent outlet opening; and an actuator for deforming the proximate side of the strip into sealing contact with the vent outlet opening.

18. A method of sealing a vent opening in a dishwasher door, comprising:

positioning an elongated flexible strip over the vent opening in spaced relation thereto so that the vent opening is open; and bending a portion of the strip into sealing relation with the vent opening to close the vent opening.

19. The method of claim 18 further comprising forming the strip of two layers of materials having dissimilar coefficients of thermal expansion and wherein the bending of the strip is accomplished by heating the strip.

20. The method of claim 18 comprising securing one end of the strip with respect to the vent opening and pushing axially on the other end of the strip to bend the central portion of the strip into sealing engagement with the vent opening.

* * * * *